United States Patent [19]

Sarnes et al.

[11] 4,165,243

[45] Aug. 21, 1979

[54] METHOD OF MAKING SELECTIVELY CARBURIZED FORGED POWDER METAL PARTS

[75] Inventors: Myron C. Sarnes, Northville; Ramjee Pathak, Canton, both of Mich.

[73] Assignee: Federal-Mogul Corporation, Southfield, Mich.

[21] Appl. No.: 911,024

[22] Filed: May 31, 1978

[51] Int. Cl.[2] ..... C21D 1/48

[52] U.S. Cl. ..... 148/16.5; 148/16.6; 148/126

[58] Field of Search ..... 148/16.5, 126; 75/200

[56] References Cited

U.S. PATENT DOCUMENTS

| | | | |
|---|---|---|---|
| 3,180,765 | 4/1965 | Townsend et al. | 148/16.5 |
| 3,344,817 | 10/1967 | Conard | 148/16.5 |
| 3,408,237 | 10/1968 | Gulliksen et al. | 148/16.5 |
| 3,661,820 | 5/1972 | Foreman et al. | 148/16.5 |
| 3,873,376 | 3/1975 | Ritzka | 148/16.5 |
| 3,992,763 | 11/1976 | Haynie et al. | 148/16.5 |
| 4,062,702 | 12/1977 | Kunst et al. | 148/16 |

*Primary Examiner*—L. Dewayne Rutledge
*Assistant Examiner*—John P. Sheehan
*Attorney, Agent, or Firm*—Robert F. Hess

[57] ABSTRACT

A powder metallurgical process for producing dense low-alloy ferrous parts having selected carburized surface portions in which a metal powder of the desired composition is briquetted into a shape-retaining preform, the preform is masked, sintered, carburized whereafter the mask is removed and the resultant preform is forged to a desired final shape. The forged part is then quenched immediately following the forge operation for hardness or if desired it can be further heat treated in another manner to obtain other mechanical properties.

12 Claims, 6 Drawing Figures

METHOD OF MAKING SELECTIVELY CARBURIZED FORGED POWDER METAL PARTS

BACKGROUND OF THE INVENTION

The process of the present invention is particularly applicable, but not necessarily restricted to, the manufacture of low-alloy ferrous parts such as gears, clutch components, races of tapered roller bearings or the like which are characterized as having working portions or surfaces that are subjected to concentrated loads, torques, or other high stresses. In order to provide satisfactory performance and durability of such parts, it has heretofore been conventional to fabricate the entire part from a suitable high performance alloy including those portions which are not subjected to high loading and stresses. In order to conserve on the use of such relatively high cost high performance alloys, it has also been heretofore proposed to fabricate composite articles incorporating the high performance alloy in those portions subjected to high loading and stresses while the remaining portion of the part is comprised of less expensive alloys. A powder metallurgical process of the last mentioned type is disclosed in U.S. Pat. No. 3,727,999 which is assigned to the same assignee as the present invention. While the fabrication of such composite parts provide for satisfactory performance and durability, the steps and tooling required for forming a composite component is somewhat costly, time consuming and labor intensive.

In order to overcome the foregoing problems, it has also been proposed to fabricate dense metal parts employing powder metallurgical techniques in which the sintered blank is subjected to carburizing over the entire surface thereof whereafter the carburized part is forged to final dimensions. A process of the foregoing type is disclosed in U.S. Pat. No. 3,992,763 which also is assigned to the present assignee. While the process described in the aforementioned U.S. Patent, to which reference is made for further details, has provided satisfactory parts, a continuing difficulty has been encountered in the final forgoing and machining operations of the part due to the presence of a carburized case over all portions of the parts. The presence of such a hard case necessitates the use of more expensive tooling during the final machining and finishing operations detracting somewhat from the economy in the manufacture of such parts.

The process of the present invention overcomes many of the problems and disadvantages associated with the aforementioned and other prior art powder metallurgical techniques in providing a process in which only selected portions of a part are carburized leaving remaining portions substantially uncarburized providing therewith a final part possessed of the requisite mechanical properties and performance which can be produced at commercial production rates and can be finish machined employing conventional equipment.

Furthermore, irrespective of any machining considerations, the process of the present invention provides an uncarburized surface on an otherwise carburized part which thus allows the possibility of electron beam welding or similar application which requires a low carbon surface.

SUMMARY OF THE INVENTION

The benefits and advantages of the present invention are achieved in a powder metallurgical process for producing substantially fully dense, low alloy ferrous parts which are characterized as having only selected surface portions thereof provided with a carburized case with the remaining portions thereof having only minimal or substantially no case hardening. In accordance with the process aspects of the present invention, a low alloy ferrous powder preferably of the AISI No. 4600 series is briquetted in a die to form a shape retaining preform. Selected portions of the preform are masked whereafter the masked preform is sintered and thereafter carburized in which exposed portions thereof are provided with a carburized case of the desired depth. Following the carburizing treatment, the mask is removed and the preform is forged to final dimensions. Preferably, at the conclusion of the forging operation, the forging is permitted to stabilize at temperature whereafter it is quenched in oil to further enhance its physical properties. The resultant forged part can thereafter be subjected to final machining and finishing operations.

In accordance with a preferred embodiment of the present invention, the briquette comprised of 4600 series steel powder is sintered at a temperature of about 2050° to 2100° F. in a protective atmosphere followed by an endothermic gas or equivalent carburizing treatment to attain the desired case depth over the unmasked sections thereof whereafter the unmasked preform is forged at a temperature of about 1600° F. to about 1850° F. to a final shape and a density approaching theoretical density. Masking of the preform to minimize or substantially eliminate carburizing of the selected masked portions is achieved preferably employing a mechanical mask which interfittingly and sealingly engages the part minimizing entrance of the carburizing gas atmosphere into the masked portion thereof. The mask may be comprised of wrought steel plate or a powder metallurgical composition and can readily be removed from the carburized preform at the completion of the carburizing treatment and recycled for reuse.

Additional benefits and advantages of the present invention will become apparent upon a reading of the description of the preferred embodiments taken in conjunction with the accompanying drawings.

DESCRIPTION OF THE PREFERRED EMBODIMENTS

Figure 1:
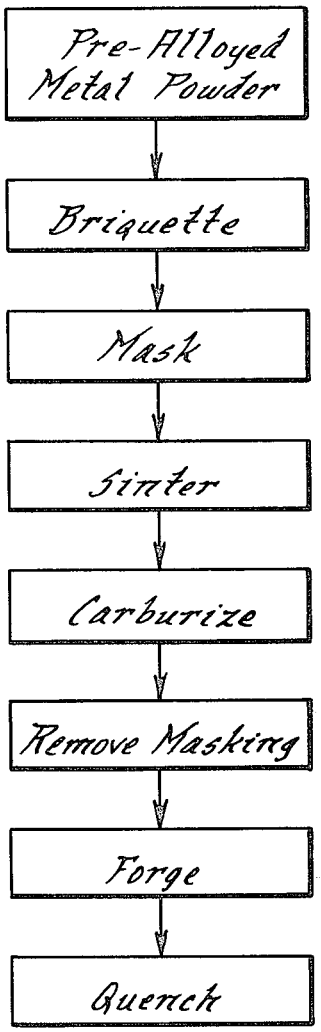
FIG. 1 is a flow diagram sequentially illustrating the preferred steps in the practice of the present process.

Referring now in detail to the drawings and as best seen in FIG. 1, the steps in the preferred practice of the present process include providing a metal powder of the desired composition which is briquetted into a green briquette of a desired configuration and which thereafter is masked over selected surface portions thereof. The masked briquette thereafter is sintered whereafter it is carburized over the exposed surface portions thereof to provide a case depth of the desired magnitude. At the completion of the carburizing treatment, the mask is removed and the sintered and selectively carburized preform is forged into a part of the desired final configuration and density. The resultant forged part is preferably quenched after stabilization of temperature to further enhance its mechanical properties. The quenched part optionally, can be subjected to further heat treatment to further optimize its mechanical properties and thereafter it is sujbected to final machining or finishing operations as may be desired or required to produce a precision part.

In accordance with the steps of the method depicted in the flow diagram comprising FIG. 1, the metal powder can comprise a powder of AISI No. 4600 series which nominally contains from zero up to about 0.5% manganese, about 0.25 to about 2.25% nickel, about 0.25 to about 0.70% molybdenum, up to about 1.25% carbon with the balance consisting essentially of iron along with convention impurities and residuals. While the powder may comprise a mechanical mixture of the several alloying constituents to provide the desired final alloy chemistry, it is preferred that the powder consist of prealloyed powder particles in which each particle comprises an alloy of the desired composition. Such prealloyed powders of the desired alloy chemistry can readily be produced by any one of a variety of techniques including water atomization of a melt of the alloy which can be screened and classified to extract particles of the desired size range. While the particle size and configuration of the metal powder is not generally thought to be critical in the practice of the present process, it is preferred to employ particles of fairly even size distribution within a range of about minus 60 mesh (U.S. standard sieve size) to about minus 325 mesh, with no more than 10% by weight being greater in size than minus 60 mesh and no more than 40% by weight being finer in size than minus 325 mesh.

The powder alloy preliminary to briquetting, is admixed with a suitable die lubricant and binder, of any of the types well known in the art. In addition, the metal powder may also be admixed with graphite to supplement and/or adjust the carbon content thereof to within a desired range.

A premeasured quantity of the metal alloy powder is placed in a die cavity of a desired configuration and is compacted in a manner well known in the art into a green briquette or preform of a size and configuration suitable for subsequent forging into a finished part of the desired configuration. The briquetting operation is performed in a manner to produce a preform of a density preferably at least 75% of 100% theoretical density, and preferably from about 85% to about 90% of theoretical density. The briquetting operation preferably employs a ram and die-set.

The resultant green briquette or preform is thereafter masked employing masking means subsequently to be described such that only selected portions of the preform are exposed. After masking, the preform is placed in a sintering furnace in which it is preliminary heated to an intermediate temperature effecting thermal decomposition and/or volatilization of the lubricant employed followed by a final sintering step which for 4600 series steel alloys preferably ranges from about 2000° to about 2100° F. The sintering is performed in a batch or continuous manner in accordance with techniques known in the art employing a protective atmosphere to avoid undesirable oxidation and scale formation on the surfaces of the powder particles. The sintering operation is carried out for a period of time sufficient to effect a diffusion bonding of the powder particles together at their points of contact forming an integral sintered matrix.

Following the sintering step, the mask and sintered preform is transferred to a carburizing furnace provided with a carbon atmosphere of any of the types known in the art including those disclosed in Metals Handbook, Volume 2, 8th Edition, Pages 67–114, published by the American Society for Metals. Preferably, class 302 endothermic base carburizing gases are employed and the carburizing treatment is carried out at a temperature generally ranging from about 1500° to about 1900° F. for a period of time sufficient to form a high carbon casing of the desired depth on the unmasked portions of the preform. Generally, case depths of the required carbon levels of about 0.4% are formed on the unmasked portion of the preform ranging from about 0.030 inch up to about 0.080 inch. The specific depths will vary depending upon the specific type of metal alloy employed, including its initial carbon content, the geometry of the preform, the final case hardness and core hardness desired, and the particular type and surface conditions to which the final part is to subjected during service, and other considerations well known in the art.

Upon removal of the sintered preform from the carburizing furnace which may be of a batch-type or, preferably, of the continuous type, the mask is removed from the sintered, and now selectively carburized, preform and coated with a lubricant and the part thereafter is subjected to forging. The forging temperature can vary from as low as about 1600° F. up to about 1850° F., beyond which high oxidation occurs and die life is detrimentally affected. These problems can not be tolerated in production of forged parts of the type described herein, namely precision forged parts being of final dimension following the forging step and wherein no machining other than minimal finish grinding is required. The foregoing preferably is carried out in a manner such that the preform is within a protective atmosphere to avoid oxidation of the surfaces thereof and is further preferably performed in a single step employing forging pressures of about 60 to about 80 tons per square inch. Following the forging operation, the forged part is permitted to stabilize in temperature whereafter it is quenched employing a liquid quenchant such as oil or a water-glycol mixture. The resultant forged part is characterized as having a density of at least about 99.6% of theoretical to a density approaching substantially that of the density of a wrought part.

Figure 2:
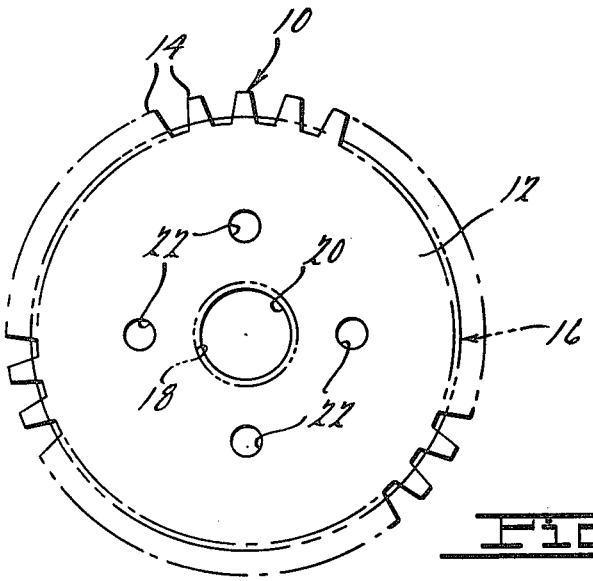
FIG. 2 is a plan view of a typical forged gear produced in accordance with the present process including tooth portions provided with a carburized case and a hub portion substantially devoid of any case hardening.

Referring again to the drawings, and as best shown in FIG. 2, a typical part produced in accordance with the practice of the present process is illustrated comprising a gear 10 consisting of an annular hub section 12 having a plurality of toothed elements 14 extending around the periphery thereof. The gear 10 is adapted to be forged from a sintered and partially carburized preform indicated in phantom at 16 which is in the form of an annular disc provided with a central bore 18 and having a peripheral diameter smaller than the diameter of the tips of the toothed portions 14. During the forging operation, the preform is densified and the metal flows to form the gear teeth and a center bore 20 to accurate final dimensions requiring only minimal, if any, final finishing operations. Since the surfaces of the toothed portions 14 as well as the surface of the center bore 20 are subjected to high stresses and loading during service, it is desirable that such portions be provided with a carburized case to increase the strength and wear resistance of the running surfaces. On the other hand, the remaining portion of the hub section 12, which is employed primarily as a mounting surface, is not subjected to such high stresses and, wear and accordingly, need not require a carburized surface treatment. The absence of a case hardened layer over the hub section 12 further facilitites subsequent machining operations to incorporate bolt holes 22 for affixing the gear to a suitable mounting member. The masking and selective carburizing process of the present invention enables a controlled carburizing of the surface of the center bore 20 and the peripheral portions defining the toothed portions 14 of the gear while the intermediate portion of the hub section 12 has only a minimal, if any, case hardening.

Figure 3:
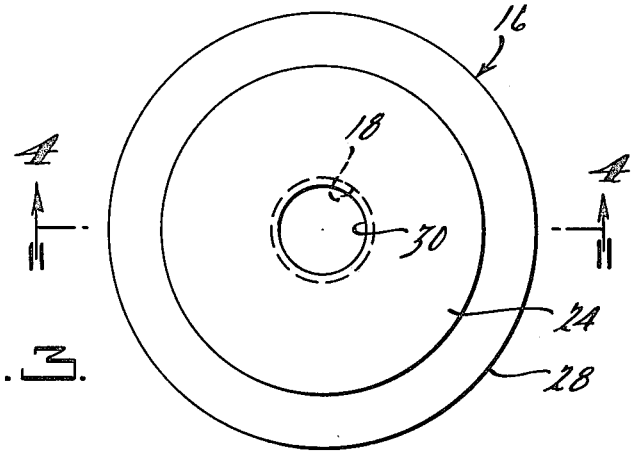
FIG. 3 is a plan view of a circular briquetted preform incorporating a mask over the center portion of surfaces thereof.
Figure 4:
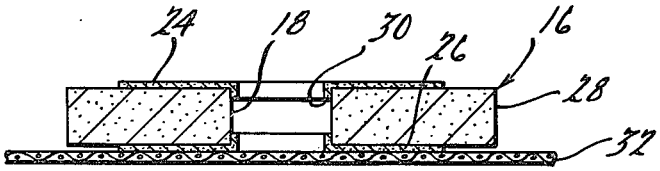
FIG. 4 is a transverse vertical sectional view of the preform and mask assembly shown in FIG. 3 and taken substantially along the line 4—4 thereof.

The controlled selective carburizing of the preform 16 to produce the gear 10 as shown in FIG. 2 is achieved, in accordance with the masking arrangement illustrated in FIGS. 3 and 4. As shown, the preform 16 prior to sintering and carburizing is masked by an upper annular mask plate 24 and a lower annular mask plate 26 which sealingly overlie the face surfaces of the hub section and extend radially to a position spaced inwardly from the peripheral surface 28 of the preform. The upper and lower mask plates 24, 26 are preferably provided with an annular inwardly projecting shoulder 30 which extends inwardly of the central bore 18 of the preform only a short distance serving to align and retain the mask plates in appropriate position during the sintering and carburizing steps. During the carburizing step, some undercutting by the endothermic carburizing gas occurs along the end edges of the mask and for this reason substantially the entire central bore 18 of the preform is provided with a controlled carburized case. A small degree of carburizing also occurs around the peripheral portions of the masked plates as a result of the inward undercutting of the carburizing gas between the mask and the opposed surface of the preform. The remaining portion of the masked surface of the preform is substantially devoid of or receives only a minimal carburizing during the carburizing step.

In accordance with the arrangement illustrated in FIGS. 3 and 4, the preform incorporating the masked plate thereover is positioned on a foraminous belt 32 of a continuous type sintering and carburizing furnace and is conveyed at a controlled rate through the various heating and carburizing zones. The weight of the preform against the lower mask plate 26 accentuates the sealing engagement therebetween while the weight of the upper mask plate 24 assures an interfit and seal between the mask and the adjacent surfaces of the preform. In the specific embodiment illustrated, the mask plates 24, 26 are comprised of a relatively dense, gas impervous material preferably comprised of wrought plate or a steel powder composition.

The mask comprised of steel powder composition offers several advantages over a wrought steel mask, namely (1) the former can be of composition substantially similar to that of which the preform is comprised thereby assuring continuity of the seal of the masks due to the similar co-efficient of expansion and contraction between the mask and the preform, and (2) the former can be decarburized to reduce or eliminate accumulated carbon content resulting from repeated use, the means of decarburization being either to add FeO to the powder content or a separate decarburizing step. The presence of FeO in the mask also helps prevent or eliminate any carburizing gas leakage between the mask and the preform by combining with the carbon. The wrought steel plate can, of course, be oxidized as well, but only on the surface, whereas the powder metal mask can be oxidized throughout. A preferred method of oxidizing the mask is to immerse the mask in water immediately following the carburizing step and heat in air or other oxidizing atmosphere at 800° F. to 1500° F. This is preferably done on a continuous basis for recycling in a continuous sintering and carburizing operation.

In the mass production of large numbers of such precision gears, it is convenient to form the mask plates by powder metallurgical techniques employing the same basic parameters as employed in producing the sintered preform. Accordingly, an appropriate die is prepared in which a powder similar to that employed for fabricating the preform is briquetted to similar densities whereafter it is sintered at elevated temperatures into an intergal component. The resultant mask produced is substantially gas impervious and can be simply stripped from the preform at the conclusion of the carburizing step and reused over and over again in the manner described above.

Figure 5:
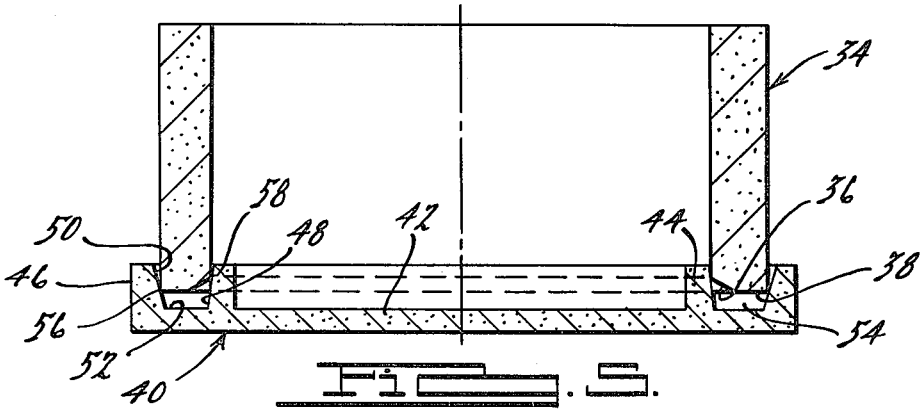
FIG. 5 is a transverse vertical sectional view of an annular briquetted preform having the lower portion thereof seated in sealing engagement within a mask.

An alternative satisfactory selective carburizing and masking arrangement is illustrated in FIG. 5 in which a circular briquetted preform 34 formed with a bevel or chamfer 36 along its lower inner edge is sintered and carburized so as to minimize carburization of its lower chamfered surface 36 and end edge 38. In the specific embodiment illustrated, a mask 40 is employed comprising a base 42 having integrally formed inner and outer concentric walls 44, 46 between which the lower edge of the preform 34 is disposed. The outer axial surface of the inner wall 44 indicated at 48 is preferably provided with a taper such as of a magnitude of 5° from the vertical while the opposed vertical surface of the outer wall 46 indicated at 50 also is preferably tapered outwardly such as at an angle of 15° from the vertical. The tapered surfaces 48 and 50 in combination with a base surface 52 define in combination an annular groove 54 of a wedge-shaped configuration for sealingly and interfittingly receiving the lower outer edge 56 and inner lower edge 58 of the preform forming a knife-edge seal therebetween. The width of the base of the annular groove 54 is less than the width of the preform to maintain a knife-edge seal between the edges of the preform and the tapered surface and to prevent a bottoming of the preform against the base of the groove. According to the foregoing arrangements shown in FIG. 5, appropriate carburizing of the entire surface of the preform 34 is effected with the exception of the chamfered surface 36 and end edge 38 disposed in sealed engagement within the annular tapered groove 54. Of course, if the mask is oxidized also, which will be preferred in certain instances, even slight seepage of carburizing gas beyond the point of sealing can be tolerated since the carbon will combine with the oxide deposited in the base portion of the groove.

The mask 40 as shown in FIG. 5 is comprised and can be fabricated in the same manner as previously described in connection with the mask plates 24, 26 shown in FIGS. 3 and 4. As previously mentioned, the mask 40 at the conclusion of the carburizing step can simply be removed from the sintered and carburized preform 34 and recycled for reuse. As will be noted in FIG. 5, the weight of the preform 34 assures a wedging action of the lower outer edge 56 and lower inner edge 58 against the tapered surfaces of the annular groove to maintain a seal against the carburizing atmosphere throughout the carburizing step.

Figure 6:
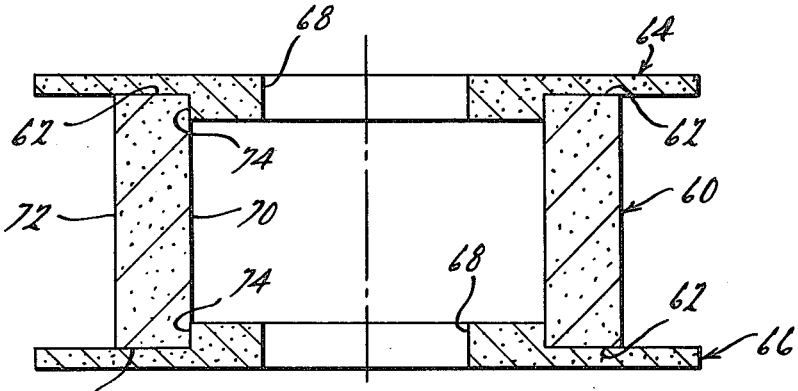
FIG. 6 is a transverse vertical sectional view of still another alternative masking arrangement for an annular briquette employing two plate masks for minimizing carburization of the end faces thereof.

An alternative satisfactory variation of the masking system of the present invention is illustrated in FIG. 6. As shown, a ring-shaped preform 60 having end faces 62 is disposed in masked, interfitting sealed relationship between an upper mask plate 64 and a lower mask plate 66. The upper and lower mask plates 64, 66 are formed with a center aperture 68 therethrough to provide for free circulation of the endothermic carburizing gas between the mask plates and in contact with the inner annular surface 70 of the preform. The outer annular surface 72 of the preform similarly is exposed to contact with the carburizing gas effecting a selective carburization of these two annular surfaces while minimizing or substantially eliminating any carburization of the end faces 62 thereof. The upper and lower mask plates are preferably provided with an annular shoulder 74 adapted to engage the inner annular surface 70 of the preform to maintain the mask plates in appropriate alignment throughout the carburizing step. The arrangement illustrated in FIG. 6 is typical of one in which the preform after forging into an annular part is to be drilled axially at circumferentially spaced intervals from one end face to the opposite end face 62 thereof. The absence of any appreciable case hardening along the surfaces substantially facilitates the drilling operation employing conventional drilling equipment.

In accordance with the various embodiments of the masking systems described in connection with the drawings, the masking means comprise a mechanical mask which can be recycled for reuse. It will be understood that alternative masking means can be employed over those selected areas of a preform to minimize or prevent any substantial carburizing thereof. Included among such alternative masking means are viscous solutions, metallic pastes, nonmetallic pastes such as ceramic or refractory powder pastes, metallic tapes or other materials which are of sufficient heat resistance and which will prevent or substantially retard carburization of the substrate over which they are applied. One such paste which has been successfully used and is available from Park Chemical Co. of Detroit, Mich. under the trademark No-Carb "W" for use in connection with conventional selective carburizing of wrought steel parts. The use of mechanical-type masks as described in connection with the drawings, constitute a preferred practice particularly when a minor amount of carburizing of the masked surface can be tolerated. The capacity of a mechanical mask to be reused almost indefinitely coupled with the simplicity of its installation and removal requiring no surface clean-up provides for distinct advantages in efficiency and economy in the selective carburizing process.

While it will be apparent that the preferred embodiments of the invention disclosed are well calculated to fulfill the objects above stated, it will be appreciated that the invention is susceptible to modification, variation and change without departing from the spirit thereof.

What is claimed is:

1. A process for obtaining a substantially fully dense, selectively and partially carburized, low-alloy ferrous, powder metal part comprising the sequential steps of:

a. briquetting a low-alloy ferrous metal powder preform having a fixed uniform initial carbon content throughout both the case and inner core thereof, the briquetted preform having at least one first surface portion thereof which in the final forged form is required to be of a certain case depth and having at least a second surface portion which in final forged form is to be substantially uncarburized, b. sealing said at least one second surface portion from the carburizing atmosphere by applying masking means substantially completely enclosing in sealing engagement said at least one second surface portion, said masking means comprising a metal member having surfaces which interfittingly engage said preform to isolate selected regions thereof from its surroundings, c. sintering said preform, d. carburizing said preform to substantially increase the initial carbon content thereof in said case by providing a controlled carbon atmosphere of rich endothermic gas and maintaining said preform in said controlled atmosphere for a predetermined period of time sufficient to obtain a desired case depth of final carbon content at said at least one first surface portion substantially greater than said initial carbon content of the case as well as the final carbon content of said inner core and said at least one second surface portion, e. removing said masking means from said preform, and f. forging said preform.

2. A process as defined in claim 1 wherein said forged part is quenched in an oil bath immediately after forging and substantial temperature stabilization of the forged part.

3. The process as defined in claim 1 wherein said masking means comprises a recyclable briquetted powder metal member of substantially the same low alloy ferrous metal composition and sintered density as that of said preform to be masked during said carburizing step.

4. The process as defined in claim 1 wherein said masking means includes a base having integrally formed inner and outer concentric walls forming an annular groove therebetween, said annular groove being adapted to receive an end edge of a preform.

5. The process as defined in claim 1 wherein said sintering step is performed at a temperature from about 2000° F. to about 2100° F. and said forging step is performed at a temperature ranging from about 1600° F. to about 1800° F., and wherein said preform is forged to a density of at least 99.6% of wrought density.

6. The process as defined in claim 5, further comprising the step of cooling said forged part immediately following forging by quenching to thereby obtain a desired case depth at said at least one first surface portion.

7. The process as defined in claim 1 wherein said masking means is comprised of a substantially flat steel plate and further including the step of oxidizing said plate prior to applying said masking means in sealing engagement with said at least one second surface portion.

8. The process as defined in claim 7 wherein said oxidizing step comprises the separate steps of heating the plate only to a temperature of about 600° F. to about 800° F., immersing the plate at such elevated temperature in a water bath, and subsequently drying the plate in an oxygen containing atmosphere.

9. The process as defined in claim 7 wherein said plate includes a base and a pair of concentric wall portions extending from said base, each wall portion having opposing wall surfaces diverging relative to one another toward the base and defining therebetween a groove, said preform being of tubular shape and having one end thereof disposed within said groove in such manner that the end edges of said preform are in sealing engagement with said wall portions and spaced from the base of said plate, whereby said end edge of said preform is entrapped within said groove and constitutes said at least one second surface portion which remains substantially uncarburized.

10. The process as defined in claim 3 wherein said powdered metal masking member includes a metal oxide.

11. The process as defined in claim 9 wherein said metal oxide comprises an oxide of iron.

12. The process as defined in claim 4 wherein said annular groove of said masking means includes outwardly diverging tapered walls.

* * * * *